United States Patent [19]

Lara et al.

[11] 4,015,160

[45] Mar. 29, 1977

[54] SPARK PLUG HAVING ELECTRODES SHAPED TO PRODUCE A HOLLOW SPARK COLUMN

[76] Inventors: Jose Hector Lara; Edward B. Williams, Jr., both of P.O. Box 876, Greenville, Tex. 75401

[22] Filed: Jan. 14, 1976

[21] Appl. No.: 649,094

[52] U.S. Cl. ..... 313/139; 313/141; 313/142; 313/143

[51] Int. Cl.[2] ..... H01T 13/20

[58] Field of Search ..... 313/138, 139, 141, 142, 313/143

[56] References Cited

UNITED STATES PATENTS

| | | | |
|---|---|---|---|
| 1,352,592 | 9/1920 | Flatau | 313/141 X |
| 1,486,710 | 3/1924 | Whittier | 313/141 X |
| 2,944,178 | 7/1960 | Schaub | 313/141 |

*Primary Examiner*—Siegfried H. Grimm
*Attorney, Agent, or Firm*—Fishburn, Gold & Litman

[57] ABSTRACT

An improved spark plug for use in internal combustion engines includes a center electrode positioned within the spark plug insulator member in a metal shell. The other electrode extends from the metal shell and has one end portion thereof spaced from one end portion of the center electrode. An annular spark discharging surface is formed on one end of the center electrode and an annular spark landing surface is formed on one end of the outer electrode with the discharging and landing surfaces being in opposed or facing relation and cooperating to provide a spark in the form of a hollow column.

8 Claims, 6 Drawing Figures

SPARK PLUG HAVING ELECTRODES SHAPED TO PRODUCE A HOLLOW SPARK COLUMN

The present invention relates to spark plugs and more particularly to a spark plug having facing electrode portions with annular spark discharging surface and annular spark landing surface in opposed and facing relation to provide a spark in the form of a hollow column.

It has been found that increasing the surface area of a spark substantially improves the starting area of ignition, therefore, combustion ignited by a spark of a larger size is completed faster than normal combustion ignited by a smaller diameter and area of spark. It has also been found that by forming the geometry of the spark discharging surface and also by forming the geometry of the spark landing surface that the discharge spark is forced to be of a larger size. It has also been found that such a larger size of spark having a larger surface area effects a more rapid burning of the fuel whereby the horsepower of the internal combustion engine is substantially improved in the beginning portion of combustion, because the time required to complete combustion is reduced. Even a minor improvement in the reduction of combustion time results in a substantial improvement in economy and performance of an internal combustion engine.

The principal objects of the present invention are: to provide an improved spark plug operative to effect improved performance and economy; to provide such a spark plug operative to focus an enlarged and thereby hotter spark between spaced electrodes; to provide such a spark plug operative to effect improved and more complete burning or combustion of fuel in a combustion chamber; to provide such a spark plug with an annular spark discharging surface in facing and opposed relation with an annular spark landing surface; to provide such a spark plug operative to provide a spark in the form of a hollow column; to provide such a spark plug wherein operation thereof is substantially free of ash buildup on the electrodes thereof; to provide such a spark plug operative to form a spark in the form of a hollow column rather than a rod-like spark, as in conventional spark plugs, thereby providing substantially greater surface area of the spark and more uniform and faster burning of the fuel than fuel ignited by a spark of a conventional spark; to provide such a spark plug wherein the spark discharging surface and the spark landing surface are in opposed and facing relation and are mirror images, one of the other; to provide such a spark plug wherein when used in internal combustion engines and each plug is similar and embodies features of the present invention, combustion will be uniform in each cylinder thereby effecting substantially smoother performance; to provide such a spark plug operative to provide a spark having a substantially increased surface area and requiring minimum electrical power to create the spark; and to provide such a spark plug which is economical to manufacture, is durable in construction, has longer useful life than conventional spark plugs, is positive in operation, and is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the improved spark plug.

Figure 1:
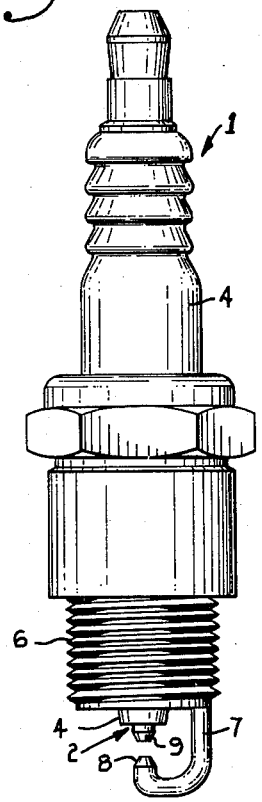
FIG. 1 is a side elevational view of a spark plug embodying features of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an improved spark plug for use in internal combustion engines (not shown). The spark plug 1 includes an elongated center or first electrode 2 extending through a centerbore 3 in an insulator member 4 mounted in a central passage 5 through a metal shell 6. An outer or second electrode 7 extends from the metal shell 6 and has one end portion 8 spaced from one end portion 9 of the center or first electrode 2. An annular spark discharging portion or surface 10 is formed on one end of the center electrode 2 and an annular spark landing portion or surface 11 is formed on one end of the outer electrode 7 with the discharging and landing surfaces 10 and 11 being in opposed or facing relation.

The spark discharging portion 10 and the spark landing portion 11 are formed by ridges on the first and second electrodes 2 and 7 respectively and the ridges are in the form of a closed geometric figure. The ridges cooperate to provide a spark in the form of a hollow column in the shape of the geometric figure. When the geometric figure is a circle, the spark discharging portion 10 and the spark landing portion 11 are annular and the spark is in the form of a hollow cylindrical column.

In the illustrated structure, the insulator member 4 is sealed within the metal shell 6 in a conventional manner, such as by using upper and lower metal ring seals 12 and 13 respectively positioned on respective shoulders of the insulator member 4. The center electrode 2 has an upper end portion thereof adapted to receive a suitable spark plug wire (not shown) in any conventional manner.

Figure 2:
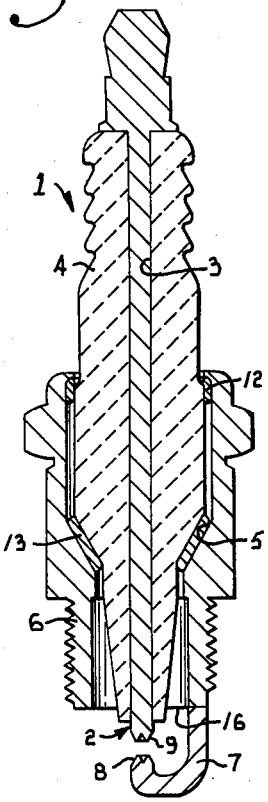
FIG. 2 is a longitudinal sectional view through the spark plug.
Figure 3:
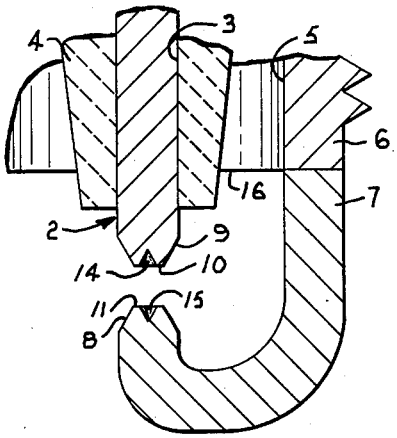
FIG. 3 is an enlarged fragmentary sectional view showing end portions of facing electrodes.

The present invention, as illustrated, includes forming the center electrode 2 as a cylindrical rod and forming the lower or the one end portion 9 of the center or first electrode 2 as a frusto-conical portion adjacent the spark discharging surface 10. The free end of the center electrode 2 has a recess 14 therein illustrated as conical and surrounded by the annular spark discharging surface 10. As best shown in FIGS. 1 to 3 inclusive, the one end portion 9 of the center electrode 2 is spaced from the lower end of the insulator member 4.

The present invention, as illustrated, also includes forming the outer electrode 7 as a cylindrical rod with the one or free end portion 8 thereof as a frusto-conical portion adjacent the spark landing surface 11. The free end of the outer electrode 7 has a recess 15 therein illustrated as conical and surrounded by the annular spark landing surface 11. The spacing between the spark discharging surface 10 and the spark landing surface 11 is determined by the operative characteristics of the respective internal combustion engine.

As illustrated in FIGS. 1 to 3 inclusive, the outer electrode 7 extends in an arcuate path from the lower end 16 of the metal shell 6 and has the free end portion thereof in opposed and facing relation with the free or lower end of the center electrode 2.

Figure 4:
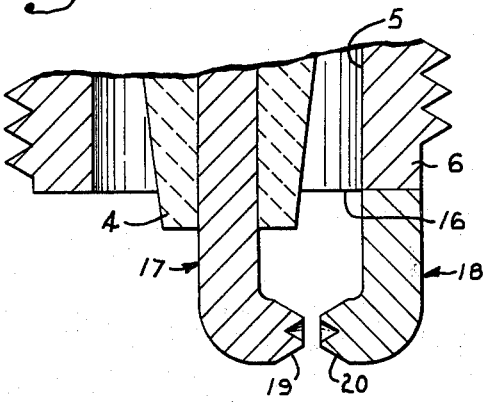
FIG. 4 is an enlarged fragmentary sectional view showing end portions of modified electrodes.

FIG. 4 illustrates a modified center electrode 17 and a modified outer electrode 18. The modified center electrode 17 has the portion thereof extending beyond the lower end of the insulator member 4 and in a generally L-shaped path with an end portion 19 thereof substantially perpendicular to the longitudinal axis of the center bore 3 of the insulator member 4.

A modified outer electrode 18 extends in a generally L-shaped path from the lower end 16 of the metal shell 6 with an end portion 20 thereof in opposed and facing relation with the free end portion 19 and coaxial with same.

The end portions 19 and 20 illustrated in FIG. 4 are essentially similar to the end portions 8 and 9 illustrated in FIGS. 1 to 3 inclusive and are positioned with the spark discharging surface and the spark landing surface thereof in opposed and facing relation. Conical recesses surrounded by the spark discharging and landing surfaces respectively are also in opposed and facing relation.

Figure 5:
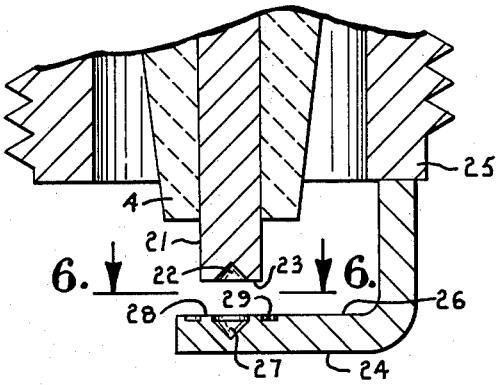
FIG. 5 is an enlarged fragmentary sectional view showing end portions of further modified electrodes.
Figure 6:
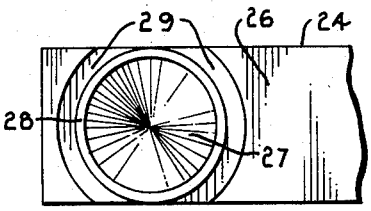
FIG. 6 is a further enlarged fragmentary view taken on line 6—6 of FIG. 5 and showing a spark landing surface of an outer electrode.

In a modified spark plug illustrated in FIGS. 5 and 6, the center electrode 21 is similar to the center electrode 2 illustrated in FIGS. 1 to 3 inclusive except the end portion thereof is not frusto-conical but does have a recess 22 therein illustrated as conical and thereby defining an annular spark discharging surface 23 on the free end of the center electrode 21.

FIGS. 5 and 6 illustrate a modified outer electrode 24 which is a generally planar bar extending from a lower end of a metal shell 25 in a generally L-shaped path. The end portion of the outer electrode 24 has one surface 26 thereof in facing relation with one end or the free end of the center electrode 21. The one surface 26 has a recess 27 therein illustrated as conical and positioned in opposed and facing relation with the conical recess 22 in the free end of the center electrode 21. The one surface 26 also has an annular spark landing surface 28 surrounding the conical recess 27 therein and positioned in opposed and facing relation with the spark discharging surface 23 on the center electrode 21.

In the form illustrated in FIGS. 5 and 6, the spark landing surface 28 is defined by recesses 29 spaced from and concentric with the conical recess 27 thereby forming the spark landing surface 28 as the closest surface to the spark discharging surface 23 whereby the spark travels the shortest route between the surfaces 23 and 28 and is a tubular spark in the form of a hollow column with a substantially increased surface area thereby igniting the fuel in a substantially shorter time.

Use of the spark plug illustrated in FIGS. 1 to 6 inclusive is substantially similar to use of conventional spark plugs, however, it has been found that forming the spark with a substantially increased surface area that the commencing of combustion is more effective than combustion ignited by conventional spark plugs and, therefore, combustion is completed substantially faster than using conventional spark plugs. It has also been found that the initial combustion is extremely critical in smoothness of operation, timing of respective power stroke, and actual power effected by combustion. Increasing the size of the spark has substantially reduced the burning or combustion time of the fuel and at no increase in the electrical power employed to create the spark.

It is to be understood that while We have illustrated and described certain forms of our invention, it is not to be limited to these specific forms or arrangement of parts herein described and shown.

We claim:

1. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member;

d. a second electrode extending from said metal shell and having one end portion thereof in spaced and facing relation with said one end portion of said first electrode; and e. means on said end portions of said first and second electrodes defining respective facing ridges each in the form of a circle thereby defining a spark discharging portion on said first electrode and a spark landing portion on said second electrode whereby said spark discharging portion and said spark landing portion cooperate to provide a spark in the form of a hollow column in the shape of the circle, said means defining said spark discharging portion including means on the one end portion of said first electrode defining a conical recess within said circle whereby said spark discharging portion is annular, said means defining said spark landing portion including means on the one end portion of said second electrode defining a conical recess within said circle whereby said spark landing portion is annular and the spark is in the form of a hollow cylindrical column.

2. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member, said first electrode being a cylindrical rod with the one end portion thereof being frusto-conical;

d. a second electrode extending from said metal shell and having one end portion thereof in spaced and facing relation with said one end portion of said first electrode, said second electrode being a cylindrical rod with the one end portion thereof being frusto-conical; and e. means on said end portions of said first and second electrodes defining respective facing ridges each in the form of a circle thereby defining a spark discharging portion on said first electrode and a spark landing portion on said second electrode whereby said spark discharging portion and said spark landing portion cooperate to provide a spark in the form of a hollow column in the shape of the circle, said means defining said spark discharging portion including means on the one end portion of said first electrode defining a conical recess within said circle whereby said spark discharging portion is annular, said means defining said spark landing portion including means on the one end portion of said second electrode defining a conical recess within said circle whereby said spark landing portion is annular and the spark is in the form of a hollow cylindrical column.

3. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member, said first electrode being a cylindrical rod with the one end portion thereof being frusto-conical;

d. a second electrode extending from said metal shell and having one end portion thereof in spaced and facing relation with said one end portion of said first electrode, said second electrode being a bar having one surface of the one end portion thereof in facing relation with the one end portion of said first electrode; and e. means on said end portions of said first and second electrodes defining respective facing ridges each in the form of a circle thereby defining a spark discharging portion on said first electrode and a spark landing portion on said second electrode whereby said spark discharging portion and said spark landing portion cooperate to provide a spark in the form of a hollow column in the shape of the circle, said means defining said spark discharging portion including means on the one end portion of said first electrode defining a conical recess within said circle whereby said spark discharging portion is annular, the one surface of the one end portion of said second electrode including means defining a conical recess within the ridge defining said spark landing portion whereby the spark is in the form of a hollow cylindrical column.

4. A spark plug as set forth in claim 3 wherein said means on said end portion of said second electrode defining said ridge of said spark landing portion includes a recess surrounding said ridge whereby said spark landing portion is positioned closer to said spark discharging portion than the remaining portions of said second electrode.

5. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member, said first electrode being a cylindrical rod with the one end portion thereof being frusto-conical;

d. a second electrode extending from said metal shell and having one end portion thereof in spaced and facing relation with said one end portion of said first electrode, said second electrode being a cylindrical rod with the one end portion thereof being frusto-conical and in axial alignment with said one end portion of said first electrode;

e. means on said one end portion of said first electrode defining a ridge in the form of a circle thereby defining a spark discharging portion in facing relation with said one end portion of said second electrode whereby said spark discharging portion provides a spark in the form of a hollow column in the shape of the circle, said means defining said spark discharging portion including means on the one end portion of said first electrode defining a concial recess within said circle whereby said spark discharging portion is annular; and f. means on said one end portion of said second electrode defining a ridge in the form of a circle thereby defining a spark landing portion in facing relation with said spark discharging portion, said spark landing portion being of corresponding size and shape to said spark discharging portion whereby the spark is in the form of a hollow column having a substantially identical cross section for the length thereof, said means defining said spark landing portion including means on the one end portion of said second electrode defining a conical recess within said circle whereby said spark landing portion is annular and the spark is in the form of a hollow cylindrical column.

6. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member, said first electrode being a cylindrical rod with the one end portion thereof being frusto-conical;

d. a second electrode extending from said metal shell and having one end portion thereof in spaced and facing relation with said one end portion of said first electrode, said second electrode being a bar having one surface of the one end portion thereof in facing relation with the one end portion of said first electrode and positioned substantially normal to the axis of said first electrode;

e. means on said one end portion of said first electrode defining a ridge in the form of a circle thereby defining a spark discharging portion in facing relation with said one end portion of said second electrode whereby said spark discharging portion provides a spark in the form of a hollow column in the shape of the circle, said means defining said spark discharging portion including means on the one end portion of said first electrode defining a conical recess within said circle whereby said spark discharging portion is annular; and f. means on said one end portion of said second electrode defining a ridge in the form of a circle thereby defining a spark landing portion in facing relation with said spark discharging portion, said spark landing portion being or corresponding size and shape to said spark discharging portion whereby the spark is in the form of a hollow column having a substantially identical cross section for the length thereof, the one surface of the one end portion of said second electrode having means defining a conical recess within the ridge defining said spark landing portion whereby the spark is in the form of a hollow cylindrical column.

7. A spark plug as set forth in claim 6 wherein said means on said end portion of said second electrode defining said ridge of said spark landing portion includes a recess surrounding said ridge whereby said spark landing portion is positioned closer to said spark discharging portion than the remaining portions of said second electrode.

8. A spark plug for internal combustion engines and comprising:

a. a metal shell having a central passage therethrough;

b. an insulator member positioned in said central passage;

c. an elongated first electrode in said insulator member and having one end portion thereof spaced from an end of said insulator member;

d. a second electrode extending from said metal shell and having one end portion thereof in spaced and facing relation with said one end portion of said first electrode; and e. means on said end portions of said first and second electrodes defining respective facing ridges each in the form of a closed geometric figure thereby defining a spark discharging portion on said first electrode and a spark landing portion on said second electrode whereby said spark discharging portion and said spark landing portion cooperate to provide a spark in the form of a hollow column in the shape of the geometric figure, said means defining said spark discharging portion including means on the one end portion of said first electrode defining a recess within said ridge on the one end portion of said first electrode, said means defining said spark landing portion including means on the one end portion of said second electrode defining a recess within said ridge on the one end portion of said second electrode, said ridges on said end portions of said first and second electrodes being of corresponding size and shape whereby the spark is in the form of a hollow column having a substantially identical cross section for the length thereof.

* * * * *